US008016170B2

(12) United States Patent
Johnson et al.

(10) Patent No.: US 8,016,170 B2
(45) Date of Patent: Sep. 13, 2011

(54) GARMENT HANGER HAVING SINGLE HANDED LOCKING DEVICE AND METHOD THEREFOR

(76) Inventors: Edward Johnson, Scottsdale, AZ (US); Buddy C. Stanley, Scottsdale, AZ (US)

( * ) Notice: Subject to any disclaimer, the term of this patent is extended or adjusted under 35 U.S.C. 154(b) by 0 days.

(21) Appl. No.: 12/247,026

(22) Filed: Oct. 7, 2008

(65) Prior Publication Data

US 2010/0084442 A1 Apr. 8, 2010

(51) Int. Cl.
*A41D 27/22* (2006.01)

(52) U.S. Cl. ..... 223/96; 223/95

(58) Field of Classification Search ..... 223/85, 223/90, 91, 93, 95, 96, DIG. 2; D6/326
See application file for complete search history.

(56) References Cited

U.S. PATENT DOCUMENTS

| | | | | | |
|---|---|---|---|---|---|
| 992,855 | A * | 5/1911 | Coney | 223/96 |
| 1,102,545 | A * | 7/1914 | Prouty | 223/96 |
| 1,342,265 | A * | 6/1920 | Johnson | 223/96 |
| 2,076,533 | A * | 4/1937 | Fuller | 223/96 |
| 2,083,077 | A * | 6/1937 | Mayer | 223/93 |
| 2,160,325 | A * | 5/1939 | Brooke | 223/91 |
| 2,200,669 | A * | 5/1940 | Cook | 223/96 |
| 2,209,864 | A * | 7/1940 | Warren | 223/96 |
| 2,212,524 | A * | 8/1940 | Huff | 223/96 |
| 2,473,898 | A * | 6/1949 | Muntwyler et al. | 223/96 |
| 2,543,108 | A * | 2/1951 | Helwig | 223/96 |
| 2,648,471 | A * | 8/1953 | Helwig | 223/96 |
| 2,970,726 | A * | 2/1961 | Brooke | 223/96 |
| 3,050,222 | A * | 8/1962 | Cates | 223/96 |
| 3,152,737 | A * | 10/1964 | Cates | 223/96 |
| 3,415,432 | A * | 12/1968 | Caves | 223/96 |
| D260,218 | S * | 8/1981 | Bisk | D6/326 |
| 5,097,996 | A * | 3/1992 | Chen | 223/91 |

* cited by examiner

*Primary Examiner* — Nathan Durham
(74) *Attorney, Agent, or Firm* — Weiss & Moy, P.C.; Jeffrey D. Moy

(57) ABSTRACT

A garment hanger has a pair of clamping members. Each clamping member comprises a pair of planer end sections and a central curved section attached to the pair of planer end members. The pair of end sections of a first clamping member will touch a corresponding pair of end sections of a second clamping member and the central curved section of the first and second clamping members form an elongated oval when the pair of clamping members is placed together in a closed position. A locking device is attached to the central curved section of the first and second clamping members. The locking device secures the pair of clamping members together. When pressure is applied to the locking device, the locking device forces opens and separates the pair of clamping members. A hook assembly is attached to the locking device.

8 Claims, 5 Drawing Sheets

GARMENT HANGER HAVING SINGLE HANDED LOCKING DEVICE AND METHOD THEREFOR

FIELD OF THE INVENTION

The present invention relates to garment hangers, and more specifically, to a garment hanger having a locking means which may be opened and closed using one hand and which securely holds a garment between a pair of clamp members.

BACKGROUND OF THE INVENTION

Garment hangers have been around for many years. Garment hangers have evolved from a basic wire hanger, which has a simple loop of wire in a flattened triangle shape that continues into a hook at the top, to more complex designs having locking clamping arms. The clamping arm garment hangers were designed to securely hold the garment between the clamping arm members once the clamping arms are closed and locked together.

While most clamping arm garment hangers do work, they have several drawbacks. First, most clamping arm garment hangers require both hands to lock and unlock the clamping arms. This makes it difficult to secure and remove the garment from the clamping arm garment hanger. Previous clamping arm garment hangers have been of a complicated nature and were expensive to fabricate. These clamping arm garment hangers required a special hanger construction to facilitate operation of the closing mechanism; utilization of a spring biasing system of one sort or another; and the application of a relatively complex closing mechanism.

Prior clamping arm garment hangers used closing mechanisms that employed a cam or over-center lever arrangement for closure. Devices of this type deteriorate with wear to the point that after continued use the closing mechanism would no longer lock and the clamping members were no longer able to secure the garment.

Therefore, a need exists to provide a clamping arm garment hanger that is able to overcome the above problems. The clamping arm garment hanger would be capable of single hand operation and would have a simplified wear-resistant locking mechanism.

SUMMARY

In accordance with one embodiment, a garment hanger has a pair of clamping members. Each clamping member comprises a pair of planer end sections and a central curved section attached to the pair of planer end members. The pair of end sections of a first clamping member will touch a corresponding pair of end sections of a second clamping member and the central curved section of the first and second clamping members form an elongated oval when the pair of clamping members is placed together in a closed position. A locking device is attached to the central curved section of the first and second clamping members. The locking device secures the pair of clamping members together. When pressure is applied to the locking device, the locking device forces opens and separates the pair of clamping members. A hook assembly is attached to the locking device.

The features, functions, and advantages can be achieved independently in various embodiments of the disclosure or may be combined in yet other embodiments.

BRIEF DESCRIPTION OF THE DRAWINGS

Embodiments of the disclosure will become more fully understood from the detailed description and the accompanying drawings, wherein.

DETAILED DESCRIPTION

Figure 1:
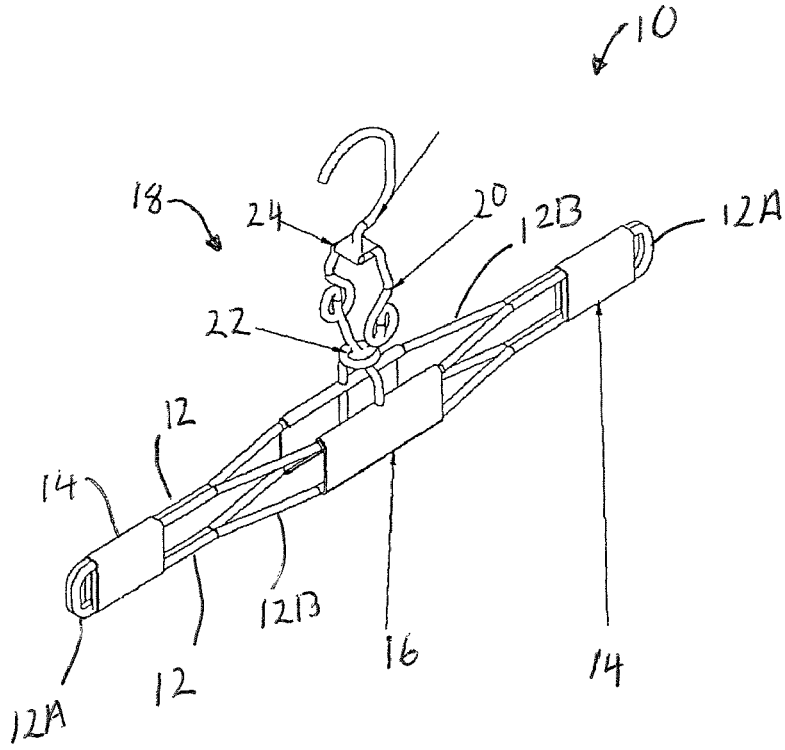
FIG. 1 is an elevated perspective view of the garment hanger of the present invention.
Figure 2:
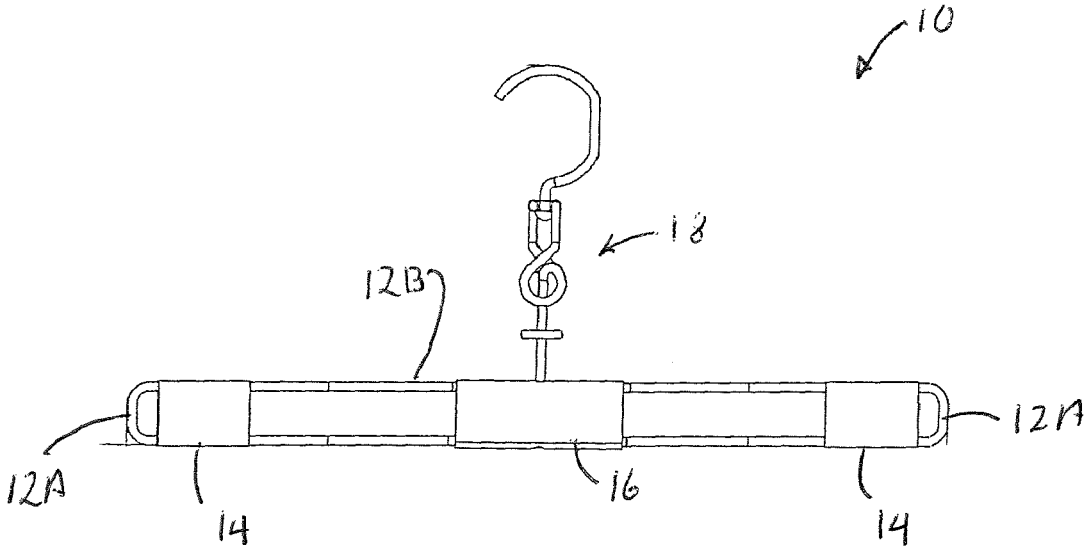
FIG. 2 is a front view of the garment hanger of the present invention.
Figure 3:
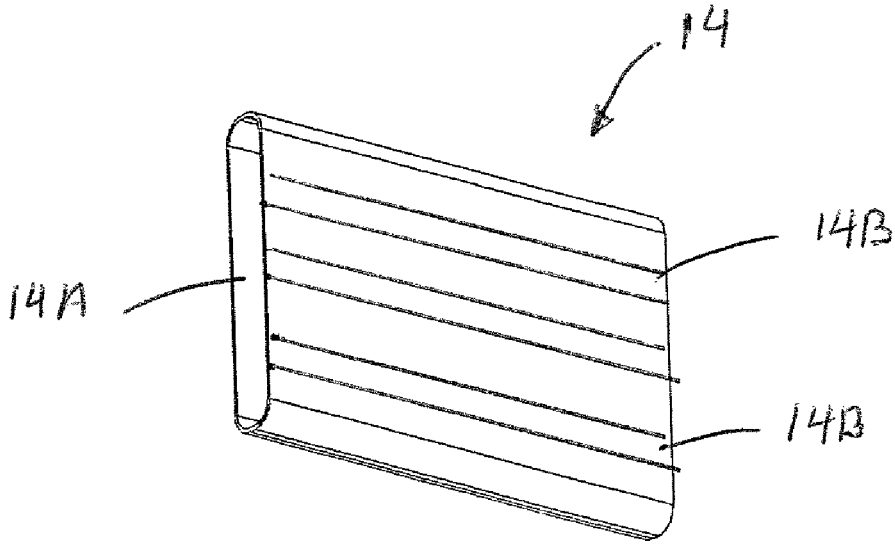
FIG. 3 is a magnified elevated side view of a gripping device used with the garment hanger of the present invention.
Figure 4:
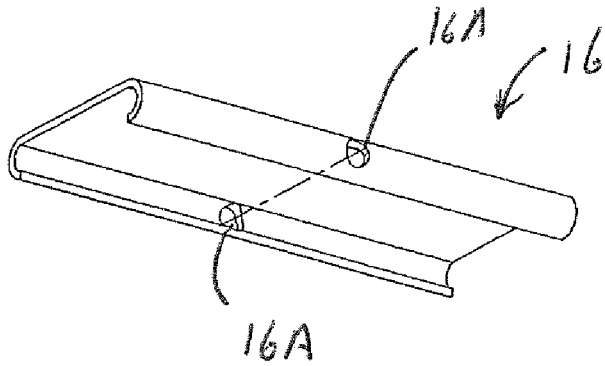
FIG. 4 is an elevated side view of a plate cover used with the garment hanger of the present invention.
Figure 5:
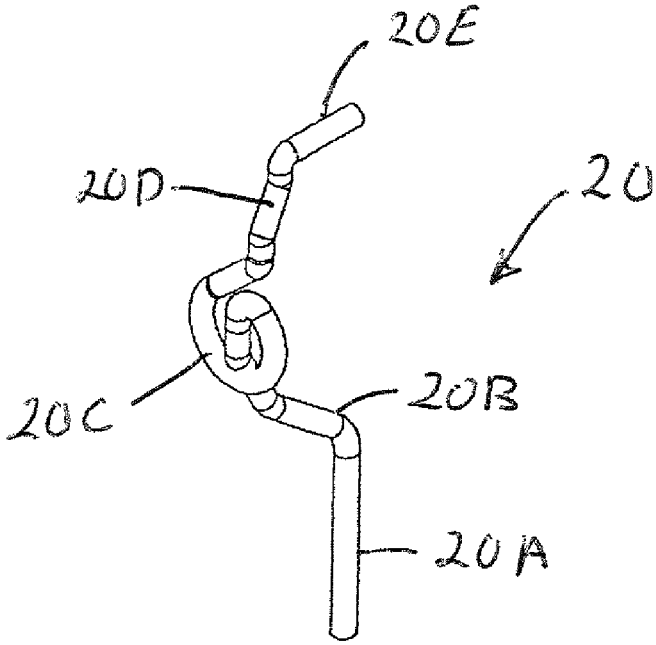
FIG. 5 is an elevated perspective view of a wire rod member of the locking device used in the garment hanger of the present invention.
Figure 6:
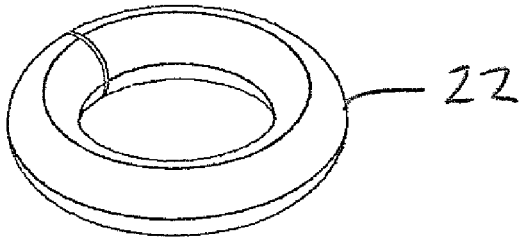
FIG. 6 is a magnified elevated perspective view of a ring member of the locking device used in the garment hanger of the present invention.
Figure 7:
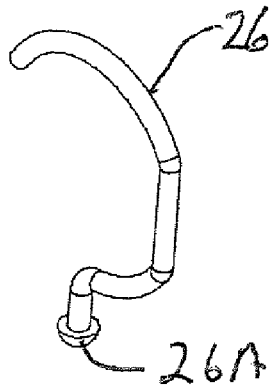
FIG. 7 is an elevated perspective view of a hook used with the garment hanger of the present invention.
Figure 8:
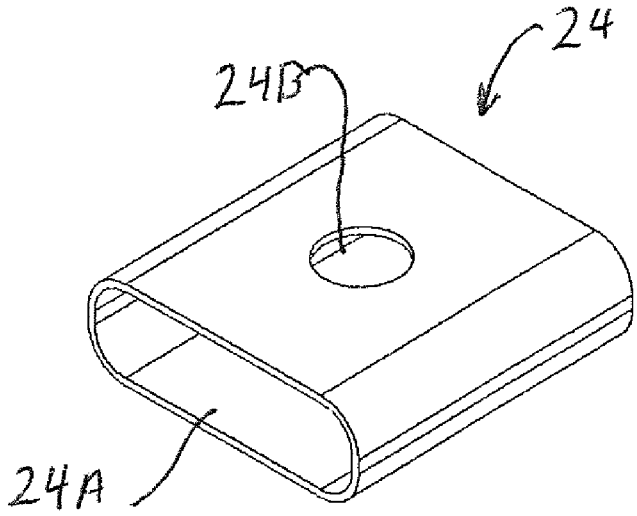
FIG. 8 is an elevated perspective view of a hook holding device used with the garment hanger of the present invention.
Figure 9:
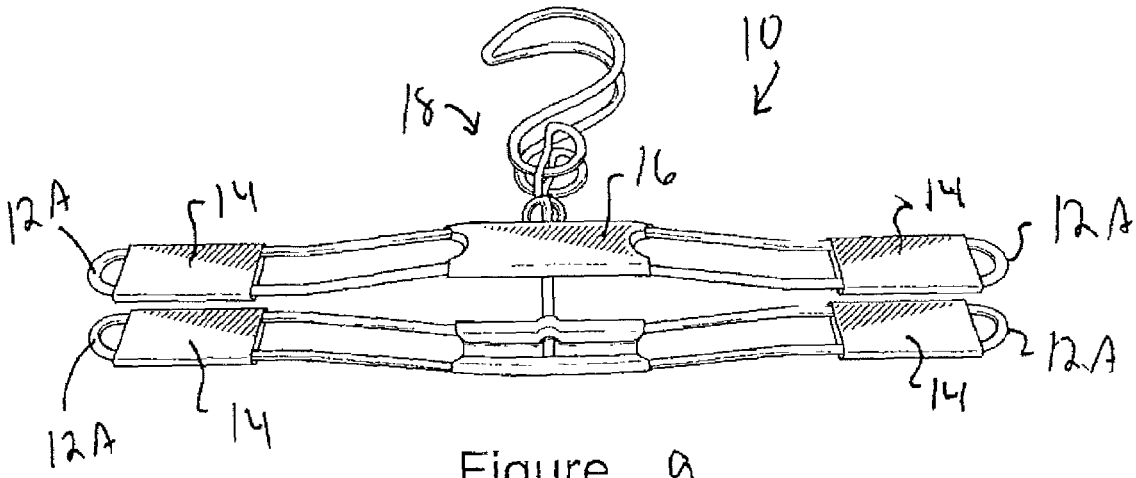
FIG. 9 is an elevated, top, perspective view of the garment hanger of FIG. 1, with the clamping members in an open position.
Figure 10:
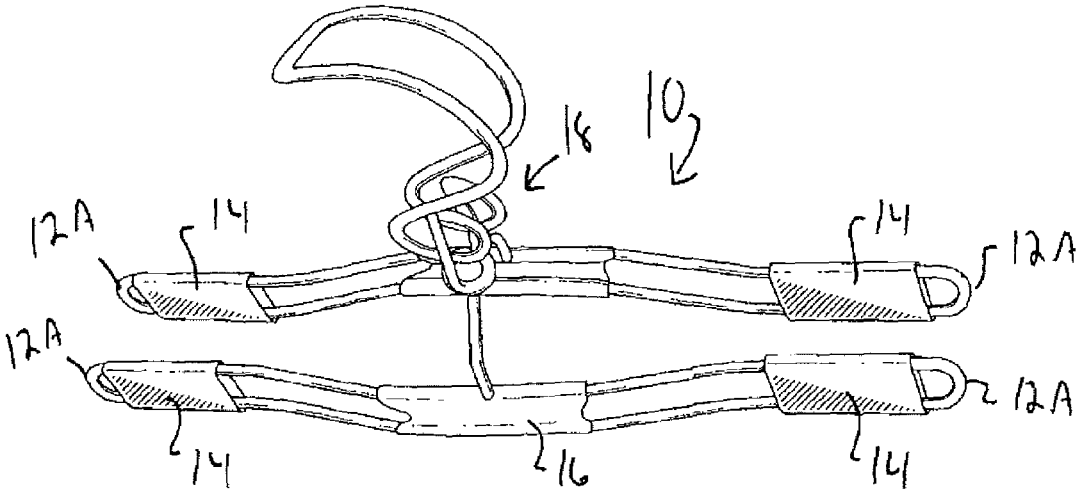
FIG. 10 is an elevated, bottom, perspective view of the garment hanger of FIG. 1, with the clamping members in an open position.

Referring to the Figures, a garment hanger 10 is shown. The garment hanger 10 allows one to open and close the garment hanger 10 to secure and hold a garment with one hand. The garment hanger 10 has a pair of clamping members 12. The clamping members 12 are used to secure and hold a garment (not shown) there between.

Each clamping member 12 has a pair of planer end sections 12A. The end sections 12A are attached to a central curved section 12B. In accordance with one embodiment, each clamping member 12 is formed of a wire rod which is bent into an elongated oval shape wherein a central section is curved and the end section 12A will be approximately planer. The wire rod is formed of a resilient material so that the clamping member 12 retains its form. The clamping members 12 are shaped such that when the pair of clamping members 12 is positioned together, the end sections 12A of one clamping member 12 are touching corresponding end sections 12A of the other clamping member 12 and the central curved section 12B of both clamping members 12 form an elongated oval having pointed ends.

Attached to each end section 12A is a gripping member 14. The gripping member 14 is used to secure and hold a garment between the pair of clamping members 12. In accordance with one embodiment, the gripping member 14 is formed of a slide resistant material such as rubber, silicon, latex, or the like. The gripping member 14 will have an oblong channel 14A which runs the length of the gripping member 14. The oblong channel 14A allows the gripping member 14 to be slid onto one of the end sections 12A of a clamping member 12. In accordance with one embodiment, an interior side of each gripping member 14 will have a plurality of ridges 14B. The ridges 14B are used to provide a tighter grip on the garment when the garment is positioned between the pair of clamping members 12.

The central curved sections 12B are used as a mechanism to push the pair of clamping members 12 together when the clamping members 12 are separated. The central curved sections 12B allow one to more easily push the pair of clamping members 12 together. Since the central curved sections 12B extend away from the planer end sections 12A, the user of the garment hanger 10 will not have to completely close his/her hand to push the pair of clamping members 12 together. This is extremely beneficial to older individuals and those who may suffer from arthritis or other muscular disorders.

Positioned on the central curved section 12B is a plate member 16. The plate member 16 is used to cover the central curved section 12B thereby providing more area for the user to push the pair of clamping members 12 together. The plate member 16 is formed of a sturdy light weight material such as aluminum, plastic or the like. It should be noted that the above is given as an example and should not be seen as to limit the scope of the present invention. In the present embodiment, the plate member 16 is shaped as a "C". The top and bottom sections of the "C" shaped plate member 16 is used to secure the plate member 16 to the clamping member 12.

In accordance with one embodiment of the present invention, each "C" shaped plate member 16 has a pair of openings 16A. The openings 16A are formed so that one opening is formed in a top section of the "C" shaped plate member 16 and a second opening is formed in as bottom section. The pair of openings 16A is approximately in axial alignment with each other.

A locking device 18 is attached to a middle section of the central curved section 12B of each clamping member 12. In accordance with one embodiment, the locking device 18 is placed through the pair of openings 16A formed in each "C" shaped plate member 16 attached to the central curved section 12B of each clamping members 12.

In a first position, the locking device 18 will secure the pair of clamping members 12 together such that the end sections 12A of one clamping member 12 are touching corresponding end sections 12A of the other clamping member 12 and the central curved section 12B of both clamping members 12 form an elongated oval having pointed ends. When the locking device 18 is pressed together, the locking device 18 will force open and separate the pair of clamping members 12. Only a slight amount of pressure needs to be applied to the locking device 18 before the locking device 18 will spring open the pair of clamping members 12.

In accordance with one embodiment, the locking device 18 is formed of a pair of wire rod members 20. The wire rod members 20 are formed of a resilient material so that the locking device 18 may flex but retains its form. Each wire rod member 20 is formed so as to have a straight section 20A which is attached to a central area of a respective clamping member 12 and rises above the respective clamping member 12. In accordance with one embodiment, the straight section 20A is attached to a top and bottom section of the a central area of a respective clamping member 12 and through the pair of openings 16A formed in each "C" shaped plate member 16 attached to the central curved section 12B of each clamping members 12.

At the end of the straight section 20A is a first angled section 20B. The first angled section 20B will run away from the respective clamping member 12 in an inward direction towards a corresponding clamping member 12. The first angled section 20B will crisscross with a corresponding first angled section 20B to form an "X". In accordance with one embodiment the first angled sections 20B runs inward and terminates above or slight past the corresponding clamping member 12 of the pair of clamping members 12.

Attached to the end of the angled section 20B that terminates approximately above or slight past the corresponding clamping member 12 is a handle section 20C. The handle section 20C is used for pushing the pair of wire rod members 20 of the locking device 18 together. By pushing the pair of wire rod members 20 together, the clamping members 12 will forced apart thereby opening the garment hanger 10 so a garment may be placed between the clamping members 12. In accordance with one embodiment of the present invention, the wire rod member 20 is bent into a circular/spiral configuration to form the handle section 20C.

Attached to the handle section 20C is an end section 20D. The end section 20D will run back slightly towards the respective clamping member 12 before being bent to form a horizontal end 20E. When the pair of wire rod members 20 of the locking device 18 is properly installed, the horizontal ends 20E of each wire rod member 20 will be approximately planer with one another.

The locking device 18 may further have a ring member 22. The ring member 22 is placed around the pair of wire rod members 20 where the pair of wire rod members 20 intersects to form the "X". The inner diameter of the ring member 22 is approximately equal to the combine width of the pair of wire rod members 20. The ring member 22 serves multiple purposes. First, the ring member 22 secures the locking device 18 in a locked position. In the locked position, the pair of wire rod members 20 intersects to form the "X". The ring member 22 secures the position of the pair of wire rod members 20 so the pair of wire rod members 20 cannot move thereby locking the pair of clamping members 12 together. When a user applies force to the handle section 20C and pushes the handle sections 20C together, the ring member 22 forces one of the pair of wire rod members 20 to slide to the side of the second of the pair of wire rod members 20 forcing the clamping members 12 apart and opening the garment hanger 10. In accordance with one embodiment, the ring member is formed of the same material as the clamping members 12 and the locking device 18.

A cover 24 is placed around the horizontal ends 20E of wire rod members 20. The cover 24 is general a rectangular enclosure having a pair of open side ends 24A to allow the horizontal ends 20E to move back and forth when the garment hanger 10 is opened and closed. An opening 24B is formed in the top of the cover 24. The opening 24B is sized to allow a hook member 26 to be rotatably attached to the cover 24.

The hook member 26 will generally have an end cap member 26A. The end cap member 26A will have a width that is larger than the width of hook member 26 and the opening 24B. The end cap 26A ensures that the hook member 26 stays attached to the cover 24.

While embodiments of the disclosure have been described in terms of various specific embodiments, those skilled in the art will recognize that the embodiments of the disclosure can be practiced with modifications within the spirit and scope of the claims.

What is claimed is:

1. A garment hanger comprising:

a pair of clamping members, wherein each clamping member comprises:

a pair of planer end sections; and a central curved section attached to the pair of planer end sections;

wherein the pair of planer end sections of a first clamping member touches a corresponding pair of planer end sections of a second clamping member and the central curved section of the first and second clamping members form an elongated oval when the pair of clamping members are placed together;

a locking device attached to the central curved section of the first and second clamping members, the locking device secures the pair of clamping members together, wherein pressure applied to the locking device forces open and separates the pair of clamping members allowing the pair of clamping members to remain open when pressure is removed from the locking device, applying pressure to the pair of clamping members forces the pair of clamping members back together, the locking device securing the clamping members together, wherein the locking device comprises:

a pair of wire rod members, wherein the pair of wire rod members comprises a first wire rod member and a second wire rod member, the first wire rod member and the second wire rod member each comprising:

a straight section attached to the central curved section of one of the pair of clamping members and rises above the one of the pair of clamping members;

a first angled section attached to the straight section, the first angled section running inward to form an "X" with a corresponding first angled section;

a handle section attached to the first angled section;

wherein the handle section is comprised of the first and second wire rod members being bent into opposing circular configurations, an end section attached to the handle section, the end section running back towards a respective clamping member and bent to form a horizontal end; and a ring member placed around the pair of wire rod members where the first angled section forms an "X" with a corresponding first angled section, an inner diameter of the ring member approximately equal to a combine width of the pair of wire rod members, the ring member securing a position of the pair of wire rod members so the pair of wire rod members cannot move locking the pair of clamping members, wherein applying force to both handle sections pushes the handle sections together, the ring member forces the first wire rod member to move from a first side of the second wire rod members to a second side of the second wire rod member separating the pair of clamping members along a horizontal plane so that the first rod member and second rod members are approximately equal distance from each other and allowing the pair of clamping members to remain open in a locked positioned with the first rod member and second rod members separated apart and approximately equal distance from each other when pressure is removed from the handle sections, applying pressure to the pair of clamping members moves the first wire rod member from the second side of the second wire rod member back to the first side of the second wire rod member forcing the pair of clamping members back together, the locking device securing the clamping members together; and a hook assembly attached to the locking device.

2. A garment hanger in accordance with claim 1, further comprising a pair of gripping members attached to the pair of planer end sections of each clamping member.

3. A garment hanger in accordance with claim 1, further comprising a plate attached to the central curved section of each clamping members and to the locking device.

4. A garment hanger in accordance with claim 1, wherein the hook assembly comprises:

a cover member attached to a top section of the locking device;

an opening formed in a top central area of the cover member; and a hook rotatably attached to the opening formed in a top central area of the cover member.

5. A garment hanger in accordance with claim 1, wherein each clamping member is formed of a wire rod bent into an elongated oval shape wherein a central section is curved and the end section will be approximately planer.

6. A garment hanger comprising;

a pair of clamping members, wherein each clamping member comprises: a pair of planer end sections; and a central curved section attached to the pair of planer end sections;

wherein the pair of planer end sections of a first clamping member touches a corresponding pair of planer end sections of a second clamping member and the central curved section of the first and second clamping members form an elongated oval when the pair of clamping members are placed together;

a locking device attached to the central curved section of the first and second clamping members, the locking device secures the pair of clamping members together, wherein pressure applied to the locking device forces open and separates the pair of clamping members along a horizontal plane so that the first rod member and second rod members are approximately equal distance from each other allowing the pair of clamping members to remain open in a locked position separated apart with the first rod member and second rod members are approximately equal distance from each other when pressure is removed from the locking device, applying pressure to the pair of clamping members forces the pair of clamping members back together, the locking device securing the clamping members together;

a hook assembly attached to the locking device;

a pair of gripping members attached to the pair of planer end sections of each clamping member; and a plate attached to the central curved section of each clamping members and to the locking device;

wherein the locking device comprises:

a pair of wire rod members comprising a first rod member and a second rod member, the first rod member and the second rod member each comprising:

a straight section attached to the central curved section of one of the pair of clamping members and rises above the one of the pair of clamping members;

a first angled section attached to the straight section, the first angled section running inward to form an "X" with a corresponding first angled section;

a handle section attached to the first angled section;

wherein the handle section is comprised of the first and second wire rod members being bent into opposing circular configurations;

an end section attached to the handle section, the end section running back towards a respective clamping member and bent to form a horizontal end; and a ring member placed around the pair of wire rod members where the first angled section forms an "X" with a corresponding first angled section, an inner diameter of the ring member approximately equal to a combine width of the pair of wire rod members, the ring member securing a position of the pair of wire rod members so the pair of wire rod members cannot move locking the pair of clamping members, wherein applying force to both handle sections pushes the handle sections together, the ring member forces the first wire rod member to move from a first side of the second wire rod member to a second side of the second wire rod member separating the pair of clamping members and allowing the pair of clamping members to remain open when pressure is removed from the handle sections, applying pressure to the pair of clamping members moves the first wire rod member from the second side of the second wire rod member back to the first side of the second wire rod member forcing the pair of clamping members back together, the locking device securing the clamping members together.

7. A garment hanger in accordance with claim 6, wherein the hook assembly comprises:

a cover member attached to a top section of the locking device;

an opening formed in a top central area of the cover member; and a hook rotatably attached to the opening formed in a top central area of the cover member.

8. A garment hanger in accordance with claim 6, wherein each clamping member is formed of a wire rod bent into an elongated oval shape wherein a central section is curved and the end section will be approximately planer.

* * * * *